United States Patent [19]

Labelle

[11] 4,383,569

[45] May 17, 1983

[54] FOLDING CLOSURE

[76] Inventor: Henri M. R. Labelle, 50 Westmooreland Ave., Cornwall, Ontario, Canada

[21] Appl. No.: 244,663

[22] Filed: Mar. 17, 1981

Related U.S. Application Data

[63] Continuation-in-part of Ser. No. 127,637, Mar. 6, 1980.

[51] Int. Cl.[3] ..... E06B 3/48

[52] U.S. Cl. ..... 160/116; 160/183; 160/200; 160/205

[58] Field of Search ..... 160/84, 116, 180, 183, 160/186, 196 R, 200, 205, 97, 234

[56] References Cited

U.S. PATENT DOCUMENTS

| | | | |
|---|---|---|---|
| 1,266,980 | 5/1918 | Norton | 160/205 |
| 1,514,140 | 11/1924 | Dodge | 160/180 |
| 1,989,658 | 1/1935 | McCloud | 160/116 |
| 2,350,305 | 5/1944 | Lapina | 160/84 R |
| 2,540,810 | 2/1951 | Clark | 160/116 |
| 2,885,000 | 5/1959 | Merrill | 160/234 |
| 3,090,424 | 5/1963 | Carlo | 160/116 |

FOREIGN PATENT DOCUMENTS

| | | | |
|---|---|---|---|
| 89084 | 4/1957 | Norway | 160/180 |

*Primary Examiner*—Peter M. Caun
*Attorney, Agent, or Firm*—Jack Paavila

[57] ABSTRACT

A folding closure having an emergency folding door therein which has a height less than the height of the closure. A folding top closure section is provided in the closure above the folding door. Means detachably connect the folding door and the folding top closure section together. The arrangement allows the folding top closure section to guide the folding door about corners when folding or unfolding the closure.

4 Claims, 13 Drawing Figures

FOLDING CLOSURE

CROSS-REFERENCE TO RELATED APPLICATIONS

This application is a continuation-in-part of U.S. application Ser. No. 127,637, filed Mar. 6, 1980.

BACKGROUND OF THE INVENTION

1. Field of Invention

This invention is directed toward improvements in folding closures.

In one aspect, the invention is more particularly directed toward a panic bar assembly for use on a folding door. The invention is also directed toward a folding door incorporating panic bar assembly.

In another aspect, the invention is directed toward a folding closure with a folding door therein, adapted to move easily around corners.

2. Description of Prior Art

Panic bar assemblies for non-folding doors, particularly non-folding, emergency exit doors, are well known. The assemblies generally include a rigid panic bar which extends horizontally across the back of the door, generally at waist level. The bar is spaced several inches away from the back of the door, and is movably mounted at its ends to fixed mounting members, one located at each side of the door. Within one of the mounting members, the bar is operatively connected to the door latch. When the bar is pushed down and toward the door, relative to the mounting members, it will automatically operate the door latch to open the door. In a panic situation, where people crowd against the door, trying to get out of a room or a building closed by the door, the people at the front of the crowd, pushed against the bar, will move it to operate the latch and thus automatically open the door.

Panic bar assemblies are usually installed in non-folding, emergency exit doors in commercial buildings or establishments because of their fool-proof operation. However, many commercial buildings or establishments, particularly those located in enclosed shopping centers or malls, now employ folding closures. The folding closure often unfolds to extend across the entire width of the establishment to close the front of the establishment. To provide an emergency exit from the closed establishment, the folding closure is often provided with a folding emergency door in its structure. This emergency door folds and unfolds along with the remainder of the folding closure. When the door is unfolded, a latch in the door can be operated and the door can be swung out to open an emergency exit in the closure. At the present time, however, no known panic bar assembly can be employed on the emergency exit door since the rigid, fixed, panic bar in the known assembly would prevent the folding of the door during folding of the closure.

The folding closure is normally hung from a track extending across the top of the opening to be closed. The closure is suspended from supports mounted on rollers which run on the track. Normally, the emergency folding door in the closure extends over the height of closure. In order to be able to open the door in an emergency however, it cannot be connected to, or hung from, the track. Thus the emergency folding door within the folding closure is normally carried by adjacent sections of the closure rather than by the track. The adjacent sections of the closure carrying the door are suspended from the track. The above arrangement however presents problems in opening or closing the closure when the closure is moved about a curved section of track to be folded or stored on a short track section which extends perpendicular to the opening, and to the side of the opening. The folding door within the closure, which is not suspended from the track, does not follow the curved section of track but instead extends across the curved section. This makes it almost impossible to move the closure about the curved section of track, in either direction, by handling it from its free end. Instead, the closure, and often the folding door, must be manually handled in the vicinity of the folding door in order to move it past the curved track section. Due to the required manual handling or manipulation, opening or closing folding closures about curved track sections, which closures incorporate full height emergency folding doors, is difficult and awkward.

SUMMARY OF THE INVENTION

It is one purpose of the present invention to provide a panic bar assembly which can be employed on folding doors. The panic bar assembly of the present invention is constructed so that the bar does not prevent folding of the emergency door, and yet is in the proper operative position when the emergency door is unfolded.

In accordance with the present invention, a panic bar assembly is provided for use with a folding door having a panic bar movable between an operative, horizontal position with the door unfolded, and an inoperative diagonal position with the door folded. The panic bar moves between its operative, horizontal position and its inoperative, diagonal position simultaneously with the folding and unfolding of the door.

In order for the panic bar to be able to move between horizontal and diagonal positions, one of the two mounting members to which the bar is connected, is movably mounted on the door for vertical movement. In addition, the panic bar is provided with two spaced-apart pivot connections in its length allowing the panic bar to move with the movable mounting member when the mounting member is moved.

It is another purpose of the present invention to provide a folding closure having an emergency folding door therein which closure, including the door, is adapted to easily move about a curved track section in opening or closing the closure.

In accordance with the present invention a folding closure is provided having an emergency folding door therein which has a height less than the height of the closure. A folding top closure section is provided in the closure above the door. The top section is fixed within the closure while the door can swing open from the closure to provide an emergency exit. Means are provided for detachably connecting the folding door and folding top section together. In addition, means are provided on the folding top closure section for movably suspending it from a track. With the above construction, the folding top section will guide the detachably connected folding door in a curved path along a curved track section thereby simplifying opening and closing of the closure. No manual manipulation is required to move the folding door about the curved track. The detachable connection permits the door to be easily disconnected from the top section when opening the door during an emergency.

The invention, in one aspect, is particularly directed toward a panic bar assembly for use in a folding door, the assembly having first and second mounting members adapted to be mounted at the sides of a folding door. At least one of the mounting members is mounted for selective movement in a vertical direction on the door. A panic bar is mounted at its ends to the mounting members. A pair of spaced-apart pivot means are provided in the panic bar allowing the panic bar to move with the one mounting member when the one mounting member is moved in a vertical direction on the door.

The invention in another aspect is also particularly directed toward a folding closure having an emergency folding door therein which has a height less than the height of the closure. A folding top closure section is provided in the closure above the door and means detachably connect the folding door and folding top closure section together.

BRIEF DESCRIPTION OF THE DRAWINGS

The invention will now be described in detail having reference to the accompanying drawings in which.

DESCRIPTION OF THE PREFERRED EMBODIMENT

Figure 1:
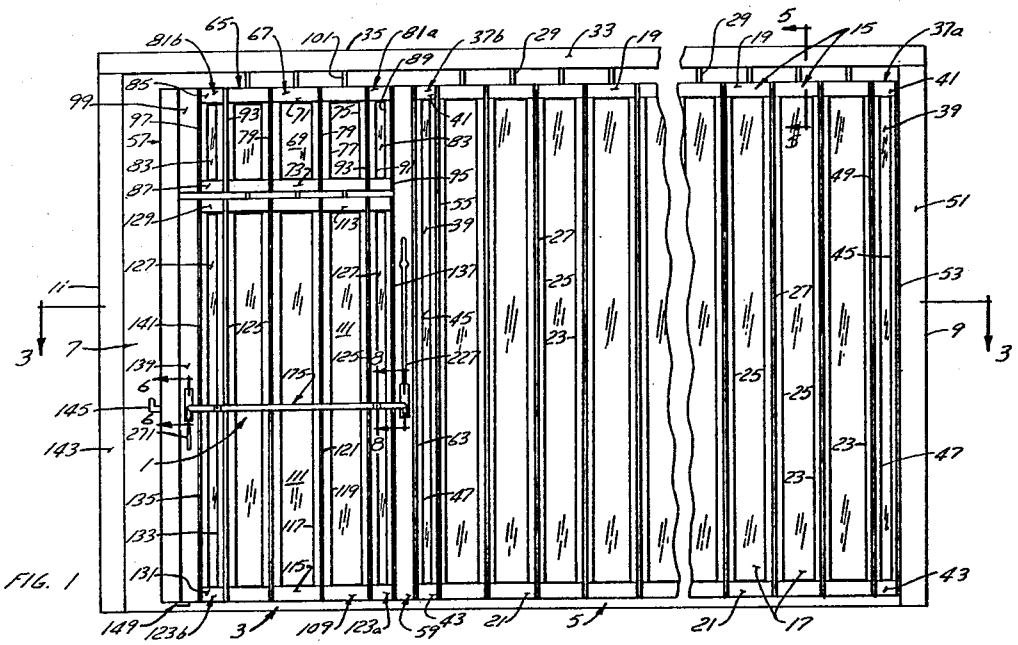
FIG. 1 is an elevation view of a portion of a folding closure, in the unfolded position, having an emergency door therein equipped with a panic bar assembly of the present invention.
Figure 3:
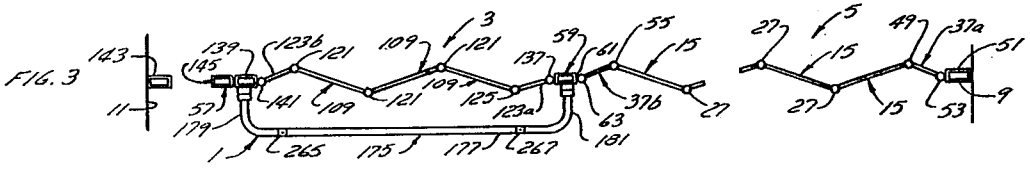
FIG. 3 is a cross-section view taken along line 3—3 of FIG. 1.
Figures 2, 5, 7, 10, 11:
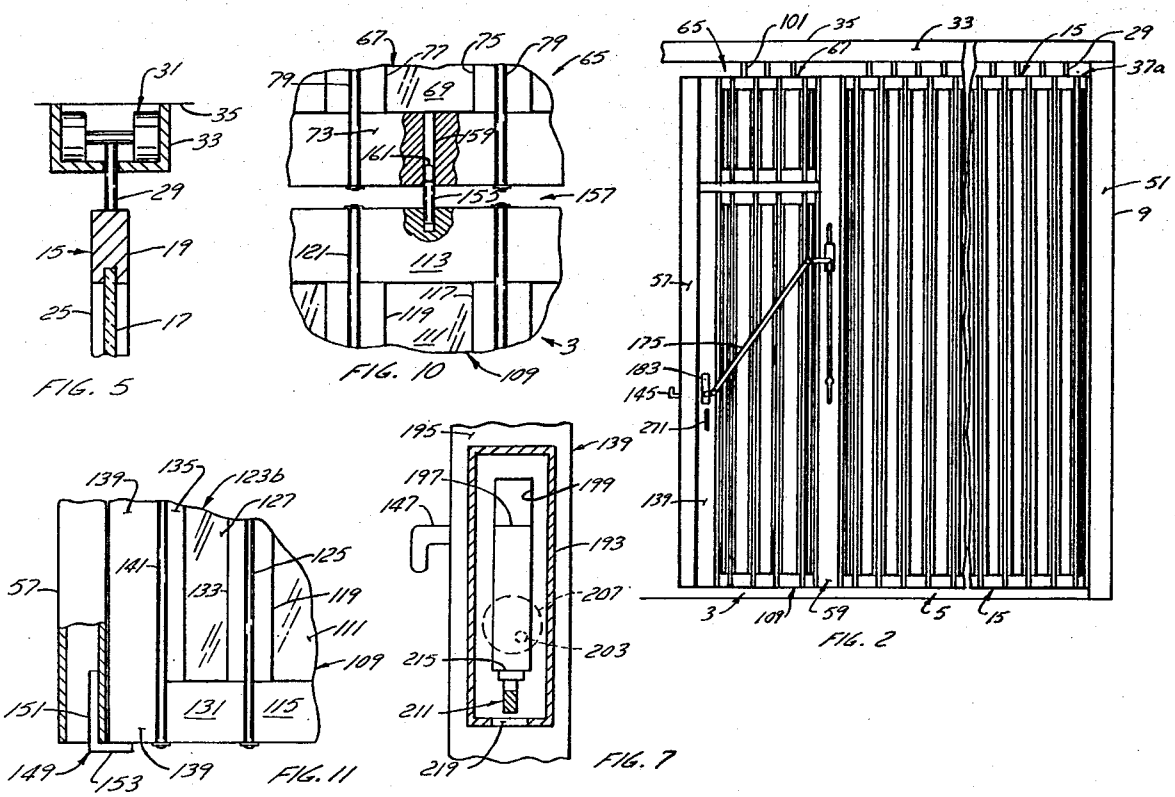
FIG. 2 is an elevation view showing the folding closure partly folded up.
FIG. 5 is a partial cross-section view taken along line 5—5 of FIG. 1.
FIG. 7 is a cross-section view taken along line 7—7 of FIG. 6.
FIG. 10 is a detail view, in partial section, of the top of the folding emergency door.
FIG. 11 is a detail view, in partial section, of the bottom of the folding emergency door.

The panic bar assembly 1 of the present invention is adapted for use in a folding door 3. The folding door 3 preferably is of the type forming part of a folding closure 5 as shown in FIGS. 1, 2 and 3. The folding closure 5 is used to close a wide entrance 7. The closure 5 is adapted to fold up within a small space at one side of the entrance when the entrance is to be opened, and to unfold to extend across the entrance from the one side 9 of the entrance to the other side 11 when the entrance is to be closed as shown in FIG. 1.

The folding door 3 folds and unfolds with the folding and unfolding of the folding closure 5. When the folding closure 5 is unfolded and closes entrance 7, the folding door 3, in its unfolded position, can be swung open from the rest of the closure 5 to open an emergency exit 13 in the closure. In the embodiment shown, the door 3 is located at one end of the folding closure. The door can however be located at any position in the folding closure 5.

In more detail, the folding closure 5 can be of the type having a plurality of tall, narrow main panels 15. Each main panel 15 comprises a large, transparent pane 17 mounted between top and bottom frame members 19, 21 and between side frame members 23, 25. Pivot means 27 hingedly connect the adjacent side frame members 23, 25 of adjacent panels 15 together. The pivot means 27 can be of any well known type normally employed in folding closures. The pivot means 27 normally limit the extent to which the closure can unfold thereby preventing the panels 15 from becoming aligned and thus facilitating folding of closure. The pivot means 27 can, by way of example, be of the type disclosed in my co-pending U.S. patent application Ser. No. 917,154, now abandoned. Each top frame member 19 has an upwardly projecting, centrally located connecting pin 29 as shown in FIG. 5 which rotatably connects to a trolley 31 running in a track 33. The track 33 is fixed to the top 35 of the entrance 7.

The closure 5 includes a pair of end panels **37*a*, 37*b* each of which is half the width of a main panel 15. Each end panel 37*a*, 37*b* also comprises a large transparent pane 39 mounted between top and bottom side frame members 41, 43 and between side frame members 45, 47. Pivot means 49 hingedly connect one end panel 37*a* along one side to the first of the main panels 15 along adjacent side frames 47, 23 respectively. The other side of the end panel 37*a* is hingedly connected to a post 51 along its other side frame 45 by pivot means 53. Post 51 is fixed to the side 9 of the entrance by suitable means (not shown). The other end panel 37*b* is hingedly connected by pivot means 55 to the last of the main panels 15 along adjacent side frames 45, 25** respectively.

The closure 5 further includes a pair of door frame posts 57, 59. The posts 57, 59 are tubular, have a rectangular cross-section, and extend the height of the closure. Post 57 forms the free end or side of the closure. The other post 59 is hingedly connected along one narrow side 61 by pivot means 63 to the side frame member 47 of end panel **37*b***.

A top folding closure section 65 connects the door frame posts 57, 59 together. The top section 65 includes a set of main panels 67, each main panel comprising a relatively short, narrow transparent pane 69 mounted between top and bottom frame members 71, 73 and side frame members 75, 77. Pivot means 79 hingedly connect the main panels 67 together at adjacent side frame members. The top section includes a pair of end panels **81*a*, 81*b*, one at each end of the set of main panels 67. Each end panel 81*a*, 81*b* has a width equal to half the width of a main panel 67. Each end panel 81*a*, 81*b* comprises a relatively short, narrow transparent pane 83 mounted between top and bottom frame members 85, 87 and side frame members 89, 91. Pivot means 93 hingedly connect one side of the end panels 81*a*, 81*b* to the main panels 67. Pivot means 95 hingedly connects the other side of end panel 81*a* to the post 59. Pivot means 97 hingedly connects the other side of end panel 81*b* to a short post member 99. This post member 99 is tubular, of rectangular cross-section and has a length equal to the length of the main panels 67 in the top section 65. The posts member 99 has a narrow side abutting a narrow side of post member 57 and is fixed thereto by suitable means (not shown). A connecting pin 101 extends up from the center of each top frame member 71 of the main panels 67. Each pin 101 rotatably connects with a trolley running on track 31. The closure 5 is suspended from the track 31 by pins 29 and 101**.

The door frame posts 57, 59 and the top folding closure section 65 of the closure define the rectangular emergency exit 13 in the closure beneath the top section 65 which exit is closed by the folding door 3. The folding door 3 includes a set of main panels 109, equal in number and width to the number and width of the main panels 67 in the top section 65. The door main panels 109 have a length nearly equal to the height of the emergency exit 13 and each comprises a relatively long, narrow transparent pane 111 mounted between top and bottom panel members 113, 115 and side frame members 117, 119. Pivot means 121 hingedly connect the main panels 109 together at adjacent side frame members. A pair of end panels 123*a*, 123*b* are included in the door, each having a width equal to half the width of the main panels 109. The end panels 123*a*, 123*b* are attached along their sides to the sides of the set of main panels 109 by pivot means 125. Each end panel comprises a transparent pane 127 mounted between top and bottom frame members 129, 131 and side frame members 133, 135. End panel 123*a* is hingedly attached along its other side frame 135 to post 59 by pivot means 137. End panel 123*b* is hingedly attached along its other side frame 133 to a tubular post 139 by pivot means 141. Post 139 has the same cross-sectional shape as post 99 in the top section 65.

In the structure described, all the various pivot means are of the same construction, differing only in length. Similarly, all the top and bottom frame members in the main panels 15, 67, and 109 are of the same construction as are the top and bottom frame members in the end panels 37*a*, 37*b*; 81*a*, 81*b*; and 123*a*, 123*b*. The side frame members in all the panels are of the same construction differing only in length.

While one form of folding closure structure has been described, other types of structures can be employed as well. For example, the main panels 15 of the folding closure 5 can be replaced with an arrangement of rods and short solid panels arranged in a checkboard pattern on the rods, the panels pivotably mounted on the rods, and the rods suspended from the track, on trolleys.

When the closure 5 is completely unfolded across the entrance 7, the end post 57 abuts a post 143 fixed to the side 11 of the entrance. A latch 145 is provided on closure 5, mounted within end posts 57 and preferably opening upwardly, to hook into latching means (not shown) on fixed post 143 to close the closure across the entrance. A lock (not shown) can also be provided in end post 57 to lock the closure in its closed position. A latch 147, preferably opening downwardly, is mounted in door post 139 to cooperate with latch receiving means (not shown) in end post 57 to keep the door 3 closed within the emergency exit 13 in closure 5. The latch 147 is operated by the panic bar assembly 1 as will be described, to open door 3.

The door 3, in its closed position, preferably rests on a stop 149. The stop 149 comprises an angle member having one leg 151 fastened at the bottom of end post 57 as shown in FIG. 11 by suitable means (not shown). The other leg 153 of the stop projects from end post 57 into the emergency exit 13 to support the bottom end of door post 139 thereon when the door is closed.

Means are provided for detachably connecting the folding door 3 and the top closure section 65 together. These connecting means can include a guide pin 155 mounted in the center of each upper frame member 113 in the main panels 109 of the door 3. Each guide pin 155 projects up from the frame member 113 to span the gap 157 between the top of the door and the bottom of the top closure section 65 and to just enter into a bore 159 extending up the center of each bottom frame member 73 in the main panels 67 of the top door section 65 as shown in FIG. 10. A screw 161 is threaded up into each bore 159 from the bottom edge of the frame member 73. The screw 161 is adjustable within the bore 159 and limits the entry of the guide pin 155 into the bore 159. The guide pins 155 normally just engage in the bores 159 to connect the door main panels 109 and the top section main panels 67 together.

When the guide pins 155 are located within the bores 159, and the door 3 is supported on stop 149, the door 3 and the top closure section 65 are detachably connected together. Now, when the closure 5 is moved about a curved section of track, such as when storing the closure 5 on a short section of track at one side of the opening and perpendicular to track section 33, the top closure section 65 will easily follow the curve in the track through its connecting pins 101 and associated trolleys. The folding door 3 will also easily follow the curved section of track, rather than cutting across it, through its connection to the top closure section 65 via guide pins 155. The guide pins 155 and associated bores 159 also serve to align and connect the folding door 3 and the top closure section 65 together to prevent entry through the gap 157 between them.

When the emergency door 3 is to be used, the front bottom corner of the door is first moved off support 149. This allows the door to sag sightly on its hinges and thus guide pins 155 move down out of bores 159 thereby disconnecting the door 3 from the top closure section 65. The door 3 can be now fully opened to provide passage through the closure 5.

Figure 12:
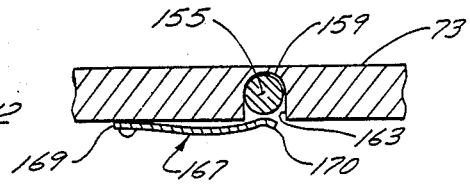
FIG. 12 is a detail cross-section view of the top folding closure section showing the clips holding the pins in place.
Figure 13:
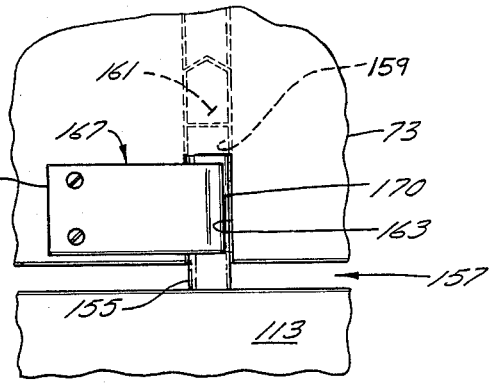
FIG. 13 is a detail elevation view of the inner side of the top closure section showing a spring clip for holding the guide pin in place.

In preferred embodiment, as shown in FIGS. 12 and 13, the bores 159 can be open along one side of the bottom frame members 73 as shown at 163. The bores 159 are opened along the inner or store side surface of the bottom frame members. The opening 163 can extend some distance up from the bottom edge of the top closure section and is wide enough to pass a guide pin 155 into or out of the bore 159. The screw 161 is located in the bore 159 a short distance above the end 165 of opening 163. A spring clip 167 is fastened along one side 169 to the inner surface of the bottom frame member 73 adjacent each opening 163. The clip 167 partly overlies the opening 163. When the closure 5 is mounted on the site, the folding door 3 is detachably connected to the top closure section 65 by sliding the pins 155 up into bores 159. The pins 155 extend for a short distance past the ends 165 of the openings 163 in the bores 159. The clips 167 help retain the pins 155 in the bores 159. When the door 3 is to be used in an emergency it is moved off support 149 as before to drop it slightly and thus lower the pins 155 slightly in bores 159 below the ends 165 of openings 163. The door 3 now can be opened by pushing it inwardly, moving pins 155 laterally out of bores 159, through openings 163 and past the free ends 170 of the spring clips 167.

While the guide pins 155 have been described as projecting up from the door 3, they can also project down from the top closure section 65 into bores provided in the top of the door.

Figure 4:
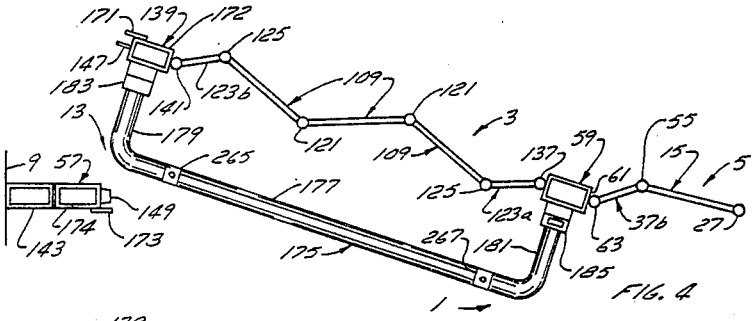
FIG. 4 is a partial cross-section view similar to FIG. 3 showing the folding emergency door open.

A stop member 171 preferably is provided on the outside surface 172 of door post 139 as shown in FIG. 4. The stop member 171 projects from post 139 to interfere with door frame post 57 and thus limit movement of the door 3 when it is being closed. Stop member 171 prevents the door 3 from moving back through the opening 13 when closing the door, and aligns posts 57, 139 so the latch 147 can close properly. If desired, a second stop member 173 can be mounted on the inside surface 174 of post 57 to interfere with door post 139. Stop member 173 operates in the same manner as stop member 171.

In accordance with the present invention, a panic bar assembly 1 is provided for the folding door 3 so that it can be easily opened from the outside in case of an emergency. The panic bar assembly 1 is mounted on the posts 59, 139 and normally extends generally horizontally across the door between the posts 59, 139 at about waist level when the door 3 is in its unfolded position. The panic bar assembly 1 includes a panic bar 175 having a relatively long handle 177 and short arms 179, 181 at each end of the handle 177. The handle 177 and arms 179, 181 merge smoothly to form a panic bar 175 having a shallow U-shape as shown in FIGS. 3 and 4. The free ends of the arms 179, 181 are mounted in mounting members 183, 185 respectively. Mounting member 183 is mounted on door frame post 139 and mounting member 185 is mounted on door post 59.

Figure 6:
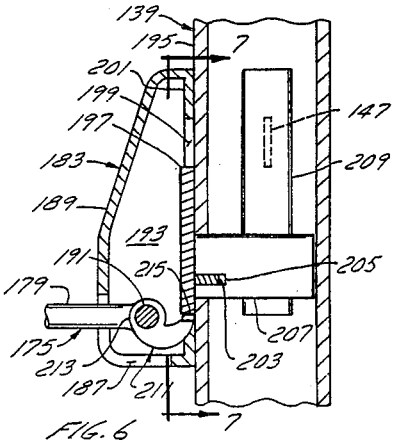
FIG. 6 is a partial cross-section view taken along line 6—6 of FIG. 1.
Figure 8:
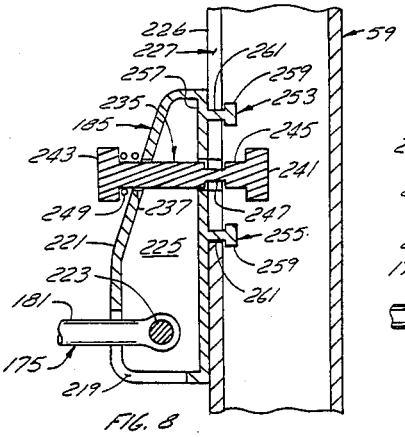
FIG. 8 is a cross-section view taken along line 8—8 of FIG. 1.
Figure 9:
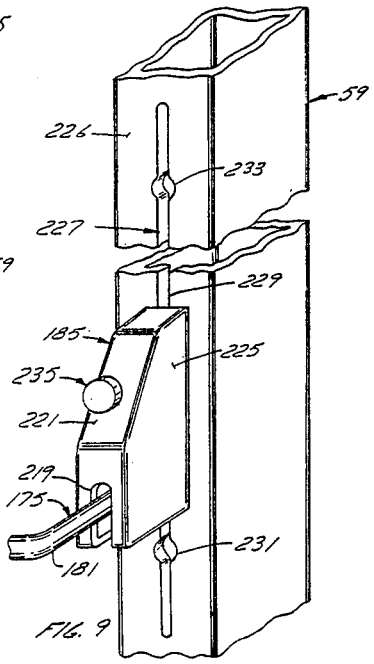
FIG. 9 is a detail perspective view of one end of the panic bar.

In more detail, arm 179 of the panic bar 175 extends through a slot 187 in the front wall 189 of the mounting member 183 as shown in FIG. 6. The end of the arm 179 is fixedly mounted on a transverse pin 191 which in turn is rotatably mounted in the side wall 193 of member 183. The mounting member 183 is itself fixedly mounted on the inside wall 195 of the door frame post 139 by suitable means (not shown). Means are provided to operatively connect the panic bar 175 with the latch 147 mounted in the door frame post 139. These means include a sliding block 197 mounted within a slot 199 formed in the rear wall 201 of the mounting member 183. The block 197 has a pin 203 projecting therefrom. The pin 203 is mounted in an off-center hole 205 provided in a cylinder 207. The cylinder 207 is rotatably mounted in the wall 195 of the door post 139 and operatively connects with the latch 147 via a locking bar 209 mounted within post 139. The cylinder 207 can comprise the cylinder of known cylinder locks, with its length cut to fit within the post 139. The cylinder 207 is rotatably mounted in the post 139 rather than fixedly as is customary with known cylinder locks. The locking bar 209 is again of known construction from known cylinder locks as is its operative connection to cylinder 207 and latch 147. A curved operating link 211 is fixedly attached at one end 213 to the pin 191. The other end 115 of the link 211 is operatively connected to the bottom end of the sliding block 197.

The other arm 181 of panic bar 175 extends through a slot 219 in the front wall 221 of mounting member 185. The end of the arm 181 is rotatably mounted on a pin 223 which is mounted between the side walls 225 of the mounting member 185. The pins 191, 223 are normally aligned. When the handle 177 of the panic bar 175 is swung down and toward the door 3, about pins 191, 223 the link 211 slides block 197 up to rotate cylinder 207 and to thus unlock the latch 147 via movement of bar 209 allowing the door 3 to open.

In accordance with the present invention, the mounting member 185 is slidably mounted on the post 59. To this end, the inside wall 226 of the post 59 has a slot 277 therein extending up for some distance from waist level. The slot 227 has a narrow main section 229 with an enlarged portion 231, 233 near each end of the main section 229. A guide pin 235 slidably connects the mounting member 185 to the post 59. The guide pin 235 projects through a hold 237 in the front wall 221 of the mounting member, and through the slot 227 into post 59. The guide pin 235 has an enlarged head 241 at one end within the post 59, and an enlarged head 243 at the other end outside the mounting member 185. One or both of the heads 241, 243 can be threadably mounted on the pin 235. The pin 235 has a first guide surface 245 adjacent inner head 241 sized to have the pin fit snugly in the enlarged areas 231, 233 of the slot 227. A second guide surface 247, adjacent the first guide surface 245, is sized to have the pin fit snugly in the narrow central portion 229 of the slot 227. A spring 249 is mounted about the pin 235 between its outer head 243 and the front wall 221 of the support member 185. The spring 249 normally tends to bias the inner head 241 against the wall 226 of post 59.

The mounting member 185 can be slidably retained against the post 59 by a pair of guide pins 253, 255 projecting from the back wall 257 of the member 185 through slot 227 into post 59. Each guide pin 253, 255 has an enlarged head 259 a and a stem 261 sized to pass through the narrow main section 229 of slot 227. The guide pins are threaded into the back wall 257 of mounting member 185, one on either side of pin 235. Other types of retaining means can be employed.

With the panic bar 175 in an operative horizontal position, the selectively movable mounting member 185 is mounted on post 59 to be level with the fixed mounting member 183. The large guide surface 245 of pin 235 is located within the lower enlarged portion 231 of slot 227 to lock the member in its lower position. To raise the mounting member 185 along face 226 of post 59, pin 235 is pushed in against spring 249 to align the small guide surface 247 with slot 227. The unit can then be moved up the narrow portion 229 of slot to the upper enlarged slot portion 233 where pin 235 is moved outwardly to lock the member 185 in its raised position.

In order for the mounting member 185 to be able to slide up and down post 59 the panic bar 175 is provided with a pair of pivot means 265, 267. The pivot means preferably comprise universal joints. One universal joint 265 is located adjacent arm 179 on handle 177 and the other universal joint 267 is located adjacent the arm 181 on handle 177.

The universal joints 265, 267 permit the panic bar 175 to move to a diagonal position as the folding closure, including the folding door 3, is folded about pivot means 27, 79, 121 to be stored along the one side 9 of the entrance 7. In moving to a diagonal position, the bar 175 avoids interfering with the folding of the closure. When the closure 5 is to be folded, the pin 235 in the mounting member 185 is pushed in to align the smaller guide section 247 on the pin with the narrow portion of the slot 227. Now as the closure, including the door, is folded, the mounting member 185 is simultaneously moved up in the slot 227 as the longitudinal distance between posts 57, 59 is reduced. The universal joints 265, 267 permit this upward movement of the one end of the panic bar relative to its other end to position the bar at a diagonal once the door is completely folded up.

When the closure is opened up or unfolded across the opening, the panic bar 175 moves back to a horizontal position, with mounting member 185 simultaneously sliding down post 59 until pin 235 locks into the lower enlarged portion of slot 227. In this position, the panic bar 175 is ready to act in a normal manner to open the door 3 in an emergency.

The door 3 can be provided with a handle 271 on post 139 just beneath the panic bar 175. The handle 271 can be used to assist in rearming the panic bar 175 after it has been actuated. The handle 271 helps to steady the door 3 while bar 175 is being reset.

While the pair of pivot means in the panic bar 175 preferably comprise a pair of universal joints, other types of pivot means, pivotably about a single axis only, could be employed as well. The universal joints are preferred since they allow the folding closure to fold around a corner.

I claim:

1. A folding closure having a plurality of tall, narrow first panels, pivot means connecting vertical sides of adjacent first panels together; an emergency folding foor in the folding closure which door had a height less than the height of the closure, the door having a plurality of tall, narrow second panels and pivot means connecting vertical sides of adjacent second panels together; a folding top closure section in the folding closure above the folding door, the top closure section having a plurality of short, narrow third panels and pivot means connecting adjacent vertical sides of adjacent third panels together; and means detachably connecting the folding door and the folding top closure section together.

2. A folding closure as claimed in claim 1 wherein the means detachably connecting the door and the top closure together comprise a plurality of spaced pins projecting up from the top edge of the folding door, and a plurality of openings in the bottom edge of the top folding closure section for receiving the top portion of the projecting pins.

3. A folding closure as claimed in claim 2 including a stop on one door frame at its bottom end for supporting the folding door by its bottom edge adjacent its unhinged side when the door is closed; said stop maintaining the door at the proper height to retain the pins in the openings; the door, when moved off the stop, detachable from the top folding closure section.

4. A folding closure as claimed in claim 2 wherein the openings in the bottom edge of the top closure are open on the inside surface of the top closure, and clip means are provided on inside surface to cover the openings.

* * * * *